US006601371B1

(12) United States Patent
Fertig

(10) Patent No.: US 6,601,371 B1
(45) Date of Patent: Aug. 5, 2003

(54) PACKAGING MACHINE

(76) Inventor: Erwin Fertig, Dillberg 12, D-97828 Marktheidenfeld (DE)

( * ) Notice: Subject to any disclaimer, the term of this patent is extended or adjusted under 35 U.S.C. 154(b) by 0 days.

(21) Appl. No.: 09/674,972

(22) PCT Filed: May 5, 1999

(86) PCT No.: PCT/DE99/01349

§ 371 (c)(1),
(2), (4) Date: Dec. 29, 2000

(87) PCT Pub. No.: WO99/57012

PCT Pub. Date: Nov. 11, 1999

(30) Foreign Application Priority Data

May 5, 1998 (DE) ..... 198 19 934
Sep. 9, 1998 (DE) ..... 198 41 138

(51) Int. Cl.[7] ..... B65B 57/00
(52) U.S. Cl. ..... 53/504; 53/51; 53/54; 53/55; 53/493; 53/64; 53/389.2
(58) Field of Search ..... 53/51, 54, 55, 53/504, 493, 64, 389.2

(56) References Cited

U.S. PATENT DOCUMENTS

| | | | | |
|---|---|---|---|---|
| 4,391,079 A | * | 7/1983 | Cherney | 53/396 |
| 4,554,774 A | * | 11/1985 | Miyashita et al. | 53/282 |
| 4,707,965 A | * | 11/1987 | Becker | 53/133.1 |
| 5,724,786 A | | 3/1998 | Singh et al. | |
| 5,826,406 A | * | 10/1998 | Massey | 53/467 |
| 5,910,090 A | * | 6/1999 | Taute | 53/504 |

FOREIGN PATENT DOCUMENTS

| | | | |
|---|---|---|---|
| DE | 196 10 255 A1 | 9/1997 | C07H/21/04 |
| EP | 0336012 A1 | 10/1989 | |
| EP | 0542393 A2 | 5/1993 | |
| EP | 0 727 487 A1 | 8/1996 | C12N/15/12 |
| EP | 0 825 198 A1 | 2/1998 | C07K/14/47 |
| WO | WO 93/24652 | 12/1993 | C12Q/1/68 |
| WO | WO 95/17430 | 6/1995 | C07K/16/44 |
| WO | WO 97/18325 | 5/1997 | C12Q/1/68 |

OTHER PUBLICATIONS

Roberts, Christopher et al., Tetrahedron Letters 1995, 36 (21):3601–3604.

Kosynkina, Larisa et al., Tetrahedron Letters 1994, 35 (29):5173–5176.

Egholm, Michael et al., Natre 1993, 365:566–568.

* cited by examiner

*Primary Examiner*—Rinaldi I. Rada
*Assistant Examiner*—Brian D Nash
(74) *Attorney, Agent, or Firm*—Edwin D. Schindler

(57) ABSTRACT

A packaging machine for wrapping and enclosing products of various dimensions and consistency in packaging material, such as paper, bags, cans and the like, includes individual processing units, to each of which a drive with a control unit is assigned. Predetermined movement rules, e.g., time-path functions, are processed by the control units. Sensors are included for detecting the operational state, wherein the movement rules of the corresponding drive are scaled when the synchronization between the packaging material and the product to be packaged deviates. The resulting path-time rule is constant and constantly differentiable, so that either the acceleration change in the non-diffentiable points of the speed-time rule is less than a predetermined limiting value, or the resulting speed-time rule is constantly differentiable.

6 Claims, 2 Drawing Sheets

PACKAGING MACHINE

BACKGROUND OF THE INVENTION

Technical Field of the Invention

Figure 1:
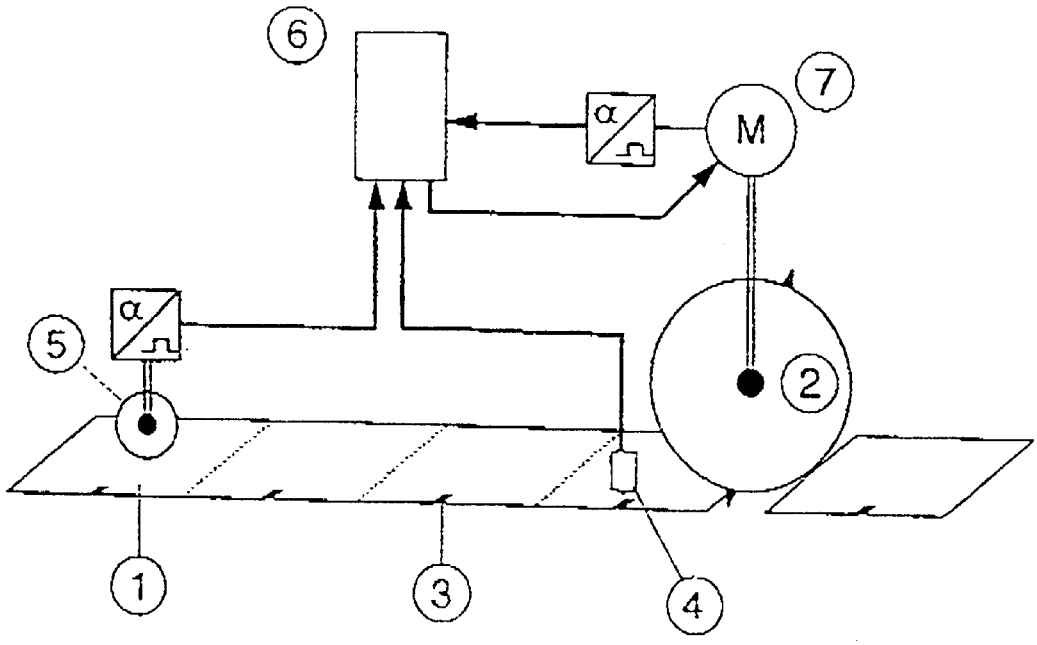

The invention relates to a packaging machine for wrapping and/or enclosing products of varying dimensions, sizes and consistency in packaging material such as paper, bags, cans or the like. The inventive packaging machine comprises individual processing units to each of which a drive with a control unit is assigned. Predetermined movement rules (time-path functions) are processed by said control units. The invention also comprises sensors for detecting the operational state.

Packaging machines are usually extensive plant which comprise a multitude of processing units for forming the packaging, filling, sealing and labelling but also foresee units that serve to supply, fill and seal prefabricated containers. The latter are used primarily to package bulk materials, especially however also liquid and pasty products from the area of foodstuffs, e.g. beverages, yoghurt cream and the like. Their prime fields of use are the pharmaceutical cigarette, foodstuffs and beverage industries.

The basic design of a packaging machine comprises a mechanically or an electronically configured kingpin, which serves as a guiding axle and to which are connected drives with control units in the sense of secondary axles. Thereby the guiding position is the input variable for the control unit of the drive which for its part defines as output variable the desired position of the secondary axle. Every position of the guiding axle is therefore assigned a defined position of the secondary axle, which is a path-path assignment. The overall movement is divided into individual movement steps to each of which a movement rule belongs by means of which an assignment of the position of the secondary axle to the position of the guiding axle is effected. The overall representation of the movement of the individual processing units is effected in a movement plan. An individual working cycle usually comprises several movement steps. The kingpin as the guiding axle defines the function speed so that the cycle performance of the packaging machine is higher the higher the guiding axle speed.

Packaging machines have as a rule to insert products of different dimensions and exterior design in a package so that the machine has to be adapted whenever the product is changed and has to be modified to the new packaging circumstances. To that end, it is known, when the machine is stopped, through manual intervention to enter the movement rules required for the next product to be processed in the machine. To that end, in the case of mechanical controls cam plates with the corresponding design are exchanged; in the case of electronic controls the movement rules are adapted to the new conditions by loading a new program or by replacing a memory chip. After commissioning, control is effected using the entered movement rules whereby, however, in a disadvantageous way an adjustment or even a reaction to unforeseeable influences does not take place. Rather the movement rule is processed exactly according to the input. Changes in geometrical conditions that occur during operation, e.g. under the influence of heat or in case of deviations from the regular procedural sequence, therefore must be ignored and sometimes result in considerable disruptions, which may cause manual interruptions. Further reasons for deviations from the desired status occur when packaging material and/or commodities are missing, faults occur with the packaging material and also with the packaging commodities and finally changes in the operating state such as state, stop, emergency stop and the like.

On this basis the invention has the object of improving packaging machines to the extent that during operation a change and adaptation of the movement rules of the drives to the actual given operating conditions is possible.

In accordance with the invention, this task is solved therein that when the synchronisation between the packaging material and the product to be packaged deviates the movement rules of the corresponding drive are scaled, that is to say they experience an extension or compression with regard to the time axis, and/or the movement rules are modified by changing the shape of the curve, and/or the combination and/or the superposition of different curves. The resulting path-time rule is constant and constantly differentiable, whereby either the acceleration change in the non-differentiable points of the speed-time rule is less than a predetermined limiting value, or the resulting speed-time rule is constantly differentiable.

In the inventive sense the term "movement rule" means every functional relationship between path and time, whereby path may be understood as a route/length or an angle. The task of the sensors provided is to record the current operating state (actual state) and to supply this data to the control unit for evaluation. Thus it is necessary, for example, to apply the packaging paper with illustrations, in spite of strains and extensions of the paper in the machine itself, to the material to be packaged so that the illustration is positioned in the centre, i.e. in the dead centre of the goods. It would be fully unacceptable to leave a displacement of the packaging paper unaccounted for with the result that the illustration would be cut wrongly and in the central region of the material to be packaged only the edge regions of the illustration would be visible. To this end, the packaging paper has markings on the edges which are recorded by the sensor so that through the corresponding control the extension, straining and slippage of the paper can be compensated.

The task of the sensor can also consist therein, among other things, to establish the presence of the material to be packaged and should it be missing the slow the transport of the packaging material and to change the movement rule so that the forward feed is delayed and is adapted to the missing packaging commodity instead of, as is usual in the state of the art, the paper being transported irrespective of the missing packaging commodity brakeless and a section of the packaging papers remains separate and unused owing to the missing packaging object.

Adjustment when there is no synchronisation between the packaging material and the object to be packaged is often attained in that the movement rules are compressed or extended with regard to the time axis. As a consequence, the movement rules are adjusted to the actual conditions. In the case of the relative displacement between the packaging material and the packaging commodities described, synchronisation is achieved in that the path-time dependency, that is the forward feed of the packaging materials, is selected so that the assignment to the packaging object is effected in the desired way.

In a further possible for modifying the movement rules the shape of the curve is changed. Thus when packaging liquid or viscous foodstuffs in cans open transport within the packaging machine along a specific stretch may be required before sealing with the lid. To ensure that the liquid to be transported does not splash out of the can, the acceleration must lie below a maximum value during this operating phase. The movement rules are therefore to be selected when open cans are transported so that only minor acceleration values occur. When the packaging machine is converted to a different commodity, this conveyance form can be ended and new movement rules with higher acceleration values can be used to increase performance.

A further option consists therein to combine and/or to superposition different movement rules, that is curves. The sensors can then record certain operating situations and react correspondingly. Thus the tearing of the paper sheet can be recorded and the machine steered accordingly. For the special case of a machine defect the machine has to be stopped slowly. In such a case the transition to a further movement rule (=abort function) is necessary which ensures that the machine is braked smoothly. It remains to be clarified that the transition to the next movement rule, that is, for example, to the abort function, can be effected immediately and within the current cycle.

For all above described options it holds that the movement rules and also the transitions between the different movement rules must be effected so that there is no significant acceleration of the machine which would cause strains on the bearings and an increase in the noise burden. Especially high wear and tear to the machine occurs as well as a sharp increase in the noise level whenever acceleration values change sharply. Therefore the invention in one of its features requires that the movement rules of the drives, independent of how the movement rule was received (compression, extension superpositioning, combining), and also in the transition regions as regards the path-time dependency, are not only a constant but also a constantly differentiable function. Mathematically this means that the differential after the time is unique ad constant in every function point. A further precondition is added for which there are two alternatives and which are determined by whether the resulting speed-time rule is differentiable in all points.

The first possibility consists therein that the change of acceleration (=as second derivation of the path-time rule) in the non-differentiable points of the speed-time rule is less than a predetermined limiting value. The changes are effected so as to be largely free of jerks and jolts, i.e. the finite acceleration jumps are minor; they are smooth because the acceleration jumps cannot become infinite at any time.

The alternative thereto is a resulting speed-time rule which is constantly differentiable, i.e. the acceleration-time rule is constant and therefore does not have any jumps. The precondition is that the speed-time rule is differentiable in all points. The change of acceleration is constant and without jumps. The are then without jerks and jolts.

In the frame of the invention it is basically optional in which way and manner the movement rules of the drives are actually created whether several generators work parallel to one another, their outputs are summed up and thus the desired movement rule is created or whether curve generators are used.

The central idea of the invention is the proposal of a control system which triggered by the deviations from the desired state established with the aid of the sensors, influences and changes the movement rules of the drives in the sense that the path-time dependency produces a constant and also a constantly differentiable function and the change of acceleration as $2^{nd}$ differential of the path-time rule after the time is in the non-differentiable points of the speed-time rule less than a predetermined limiting value.

The advantages attainable with the invention are manifold: Owing to the corresponding selection of the movement rules and the "smooth" transitions it can be ensured that constantly solely minor accelerations occur. The consequence is that the packaging machine, as regards the material and the machine itself, is bumpless and largely free of jerks and jolts and thus can be gently run. The consequence is an increase of the service life and a reduced propensity for repairs. On the other hand, such a machine can run to a higher performance compared with the prior art. Decisive is that with continuous operation, i.e. without stopping the machine, the movement rule is changed. This also allows a further considerable increase in profitability.

Already mentioned briefly was that the way and manner in which the resulting movement rule with the described characteristics is generated is basically optional wit the frame of the invention. One of the possibilities consists therein to select as output functions mathematical standard functions which experience corresponding to the described models a change through extension or compression along the time axis and/or a change of the shape of the curve and/or a combination and/or a superposition and in this way create the resulting movement rule. Termed standard functions are polynomials, exponential functions, logarithmic functions and trigonometric functions (sin, cos, tg, ctg). Thus only such movement rules are obtained as results which can be derived from the standard functions.

As an express alternative it is stated that the movement rules can be generated during operation and without access to output functions. Through suitable computation methods the resulting movement rule is determined that meets the aforemnentioned conditions, that is a process of synthesis is executed which operates without using output functions.

A decisive advantage of the inventive packaging machine consists therein that through the deviations recorded by the sensors the movement rules of the drives are changed immediately, i.e. in real time, and can be adapted to the current situation. Thus deviations are immediately cleared in the nature of a control loop. However, the basic possibility exists that the reaction to the deviations measured with the aid of the sensors is not immediate, i.e. in real time, but that the movement step currently being processed is executed as in the previous settings and not until one of the next e.g. the immediate subsequent movement step, is the drive adapted to the new situation as regards its movement rule and then is processed by the drive. The drive then reacts with a time delay to the recorded deviations.

With certain products, between the phase of filling and sealing of the container, especially high requirements must be met to ensure reliably that the filled liquids do not spill during the transport phase between filing and sealing. When beverages are filled in cans and with paper packaging the described difficulties occur in the typical way. In such a case, in a special embodiment it is recommended to either select the acceleration-time function that is less than a predetermined value, the limiting value, or to embody the jolt function, which describes the change of the acceleration values, so that it is constant. For mathematical reasons a continuity is always obtained if the acceleration-time dependency represents a constantly differentiable function. It is to be clarified that compared with the most general requirements of the invention, namely the constant differentiability of the path-time profile, solely the continuity of the speed-time function results. A constant differentiability of the acceleration-time function is not required in the most general case.

Further details, features and advantages of the invention can be taken from the following description part in which with the aid of the schematic diagram represented in the drawing the inventive claimed control unit is described in greater detail. It shows:

FIG. 1 a device to cut to length the packaging paper

Figure 2:
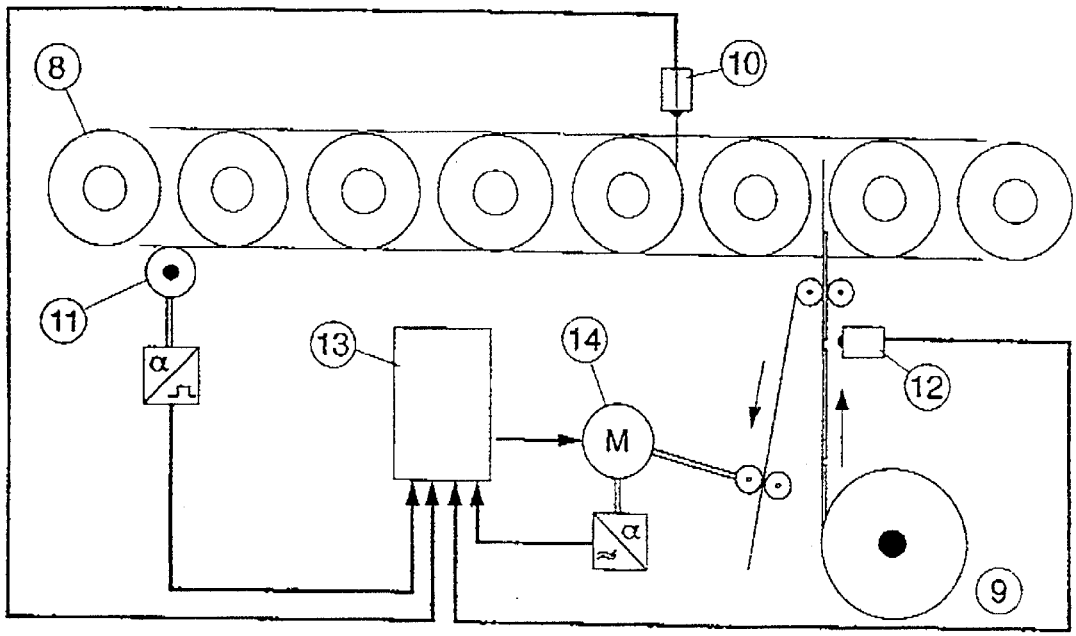

FIG. 2 the application of labels to bottles

In FIG. 1 the packaging paper (1) is fed in a horizontal direction endlessly from left to right to a rotating cutting device (2).

In the edge region of the paper there are markings (3) which are recorded with the aid of a sensor (4). Simultaneously the forward feed movement (5) is also given to the evaluation unit (6). In accordance with the paper feed and the measured values from the sensor (4), the drive (7) of the cutting device (2) is steered via the evaluation unit (6). The sensor ensures that in spite of displacement of the packaging paper in the direction of transport it is always guaranteed that the cutting device (2) cuts exactly in the desired position. Decisive is that hereby the movement rule of the cutting device (2) is a constant and also a constantly differentiable path-time function and that the acceleration changes are minimised so that "smooth" movements are ensured which have substantial advantages as regards care of the materials, the service life of the machine as well as the maximum performance.

FIG. 2 also shows a schematic representation of part of the packaging machine in which labels are applied to bottles. Here the bottles (8) are fed in a horizontal direction successively past a label dispenser (9) whereby the respective position of the bottle is recorded via a sensor (10) immediately prior to the application of the label. The bottle movement is recorded hereby with the aid of the sensor (11).

The position of the supplied label is recorded via the label sensor (12) and the information is forwarded to the evaluation unit (13). From there the corresponding control commands are forwarded to the drive (14) responsible for the forward feed of the labels. Here, too, the evaluation unit (13) ensures that the bottle (8) and the individual label are supplied synchronously to each other and therefore are combined to fit accurately. If any deviations occur, the movement rule, at least that of the drive, here, e.g. drive (14), is changed as regards its movement rule for the label forward feed and adapted to the new conditions so that the path-time function of the movement rule of the motor is a constant and a constantly differentiable function.

Decisive for the invention is that with a loss of synchronisation one drive is changed as regards its movement rule and is adapted to the actual situation, whereby of inventive importance is that during every phase the movement rule of the path-time function is always constant and constantly differentiable.

What is claimed is:

1. A packaging machine for wrapping products of varying dimensions and consistency in packaging materials, comprising:

a drive for a feed movement of a packaging material and for products being wrapped with the packaging material;

means for controlling movement of said drive in accordance with predetermined movement rules defined by a time-path function having a time axis and a path/position axis;

sensors means for monitoring operation of said drive and of said movement vis-a-vis the packaging material and products being wrapped, said sensor means including means for registering deviations in synchronicity of the movement of the packaging material and the products being wrapping;

means for comparing said deviations in the synchronicity of the movement of the packaging material and the products being wrapped with said predetermined movement rules defined by said time-path function; and, means for adjusting the movement of the packaging material and the products being wrapped in response to said deviations in the synchronicity of said movement by continuously scaling said time-path function with respect to solely the time axis of said time-path function by continuously extending or compressing said time axis of said time-path function for correcting said deviations in the synchronicity of said movement of the packaging material and the products being wrapped.

2. The packaging machine for wrapping products of varying dimensions and consistency in packaging materials according to claim 1, wherein mathematical standard functions are output functions for forming said predetermined movement rules.

3. The packaging machine for wrapping products of varying dimensions and consistency in packaging materials according to claim 1, further comprising means for generating said predetermined movement rules during operation of said packaging machine.

4. The packaging machine for wrapping products of varying dimensions and consistency in packaging materials according to claim 1, wherein said means for adjusting the movement of the packaging material and the products being wrapped in response to said deviations in the synchronicity of said movement is carried out in real time.

5. The packaging machine for wrapping products of varying dimensions and consistency in packaging materials according to claim 1, wherein said means for adjusting the movement of the packaging material and the products being wrapped in response to said deviations in the synchronicity of said movement is carried out in a subsequent work cycle.

6. The packaging machine for wrapping products of varying dimensions and consistency in packaging materials according to claim 1, wherein said continuously scaling said time-path function includes a constantly differentiable acceleration-time function.

* * * * *